US010752486B2

(12) United States Patent
Chao et al.

(10) Patent No.: US 10,752,486 B2
(45) Date of Patent: Aug. 25, 2020

(54) BEVERAGE SUPPLIER WITH EMPTYING AND COOLING FUNCTIONS

(71) Applicant: Chien-Chih Chen, Tainan (TW)

(72) Inventors: Chien-Shun Chao, Taichung (TW); Chien-Chih Chen, Tainan (TW); Po-Han Chao, Taichung (TW)

(73) Assignee: Chien-Chih Chen, Tainan (TW)

( * ) Notice: Subject to any disclaimer, the term of this patent is extended or adjusted under 35 U.S.C. 154(b) by 0 days.

(21) Appl. No.: 16/289,927

(22) Filed: Mar. 1, 2019

(65) Prior Publication Data

US 2019/0322516 A1 Oct. 24, 2019

(30) Foreign Application Priority Data

Apr. 18, 2018 (TW) ..... 107113142 A

(51) Int. Cl.
*B67D 1/08* (2006.01)
*B67D 1/12* (2006.01)
*B67D 1/10* (2006.01)

(52) U.S. Cl.
CPC ..... *B67D 1/0857* (2013.01); *B67D 1/0888* (2013.01); *B67D 1/10* (2013.01); *B67D 1/1277* (2013.01)

(58) Field of Classification Search
CPC ..... B67D 1/0857; B67D 1/0888; B67D 1/10; B67D 1/1277; B67D 1/0431; B67D 1/0869; B67D 1/0867; B67D 1/1275; B67D 1/02; B67D 1/08
USPC ..... 222/148, 149, 146.1, 146.6, 146.5, 54; 62/389, 393, 399
See application file for complete search history.

(56) References Cited

U.S. PATENT DOCUMENTS 3,896,716 A * 7/1975 Carasso ..... A23C 9/1524 99/452
4,477,003 A * 10/1984 Baker ..... B67D 7/02 222/144.5
4,730,463 A * 3/1988 Stanfill ..... B67D 1/0867 222/146.6
5,535,600 A * 7/1996 Mills ..... B67D 1/0867 62/390
6,164,083 A * 12/2000 Leeming ..... B67D 1/0054 222/146.6

(Continued)

FOREIGN PATENT DOCUMENTS

CN 1133690 A 10/1996
CN 200970137 Y 11/2007

(Continued)

*Primary Examiner* — Lien M Ngo
(74) *Attorney, Agent, or Firm* — Muncy, Geissler, Olds & Lowe, P.C.

(57) ABSTRACT

A beverage supplier includes: an inlet conduit communicated with a beverage container; a pumping and cooling device communicated with the inlet conduit, pumping and cooling a beverage from the beverage container, and outputting a cooled beverage; and an output unit, which is electrically connected to the pumping and cooling device and controls output of the cooled beverage. In a first state, the pumping and cooling device pumps and cools the beverage from the beverage container through the inlet conduit. In a second state, the pumping and cooling device empties the cooled beverage remained in the pumping and cooling device.

15 Claims, 12 Drawing Sheets

(56) References Cited

U.S. PATENT DOCUMENTS

| | | | | |
|---|---|---|---|---|
| 6,405,555 | B1 * | 6/2002 | Rowland | B67D 1/0861 62/389 |
| 6,719,175 | B2 * | 4/2004 | Mackenzie | B67D 1/0004 222/335 |
| 6,915,926 | B2 * | 7/2005 | Naik | B67D 1/0857 222/129.1 |
| 8,387,826 | B2 * | 3/2013 | Tsubouchi | B67D 1/0406 222/146.6 |
| 8,678,048 | B2 * | 3/2014 | Buchik | B67D 1/04 141/48 |
| 8,733,595 | B2 * | 5/2014 | Anselmino | F25D 23/126 222/1 |
| 8,974,846 | B2 | 3/2015 | Burton-Wilcock et al. | |
| 9,060,646 | B2 * | 6/2015 | Ait Bouziad | A47J 31/4485 |
| 9,930,987 | B2 | 4/2018 | Hulett et al. | |
| 10,315,236 | B2 * | 6/2019 | Bertness | B08B 9/0325 |
| 2003/0161923 | A1 * | 8/2003 | Holland | B67D 1/0054 426/524 |
| 2004/0009281 | A1 * | 1/2004 | Green | A47J 31/4485 426/590 |
| 2004/0118291 | A1 * | 6/2004 | Carhuff | A47J 31/401 99/275 |
| 2007/0175927 | A1 * | 8/2007 | Ozanne | A47J 31/32 222/334 |
| 2008/0223410 | A1 * | 9/2008 | Molloy | B08B 9/0323 134/22.11 |
| 2009/0320693 | A1 | 12/2009 | Ozanne | |
| 2013/0104743 | A1 * | 5/2013 | Deo | A47J 31/60 99/275 |
| 2013/0146109 | A1 * | 6/2013 | Cavilia | B08B 9/032 134/56 R |
| 2013/0209636 | A1 | 8/2013 | Cominelli et al. | |
| 2016/0009537 | A1 | 1/2016 | Orita | |
| 2016/0176693 | A1 * | 6/2016 | Lawler | B67D 1/1277 222/148 |

FOREIGN PATENT DOCUMENTS

| | | | |
|---|---|---|---|
| EP | 1748027 | B1 | 10/2010 |
| TW | 273300 | | 3/1996 |
| TW | 306736 | U | 5/1997 |
| TW | 200824625 | A | 6/2008 |
| TW | M398394 | U | 2/2011 |
| TW | I351939 | B | 11/2011 |
| TW | I563952 | B | 1/2017 |
| TW | I610628 | B | 1/2018 |
| TW | M554975 | U | 2/2018 |
| TW | I619667 | B | 4/2018 |
| WO | WO2013019963 | A2 | 2/2013 |

* cited by examiner

BEVERAGE SUPPLIER WITH EMPTYING AND COOLING FUNCTIONS

CROSS-REFERENCE TO RELATED APPLICATIONS

This application claims priority of No. 107113142 filed in Taiwan R.O.C. on Apr. 18, 2018 under 35 USC 119, the entire content of which is hereby incorporated by reference.

BACKGROUND OF THE INVENTION

Field of the Invention

The invention relates to a beverage supplier, and more particularly to a beverage supplier with emptying and cooling functions.

Description of the Related Art

Small beer foaming machines are available on the market. An easy-open beer can is refrigerated. After the beer can is cooled, the cap is opened, and the beer can is placed into the beer foaming machine having a pump and a bubbler. The pump pumps the beer from the beer can, and the bubbler bubbles the beer to produce foam or bubbles and then the bubbled beer is discharged to a cup, so that the cooled and bubbled beer can be provided. Although the beer foaming machine mainly functions to bubble or foam the beer, the following drawbacks are present.

(a) The beer foaming machine cannot freeze and cool the beer, and it is very inconvenient because the beer can needs to be refrigerated before foaming.

(b) The beer foaming machine has the bubbler for producing the foam. If the beer is not completed discharged, then the beer remained in the conduit of the beer foaming machine gets oxidized due to the contact with the air, and becomes bitter and cannot be easily drunk.

(c) At present, if the commercially available beer foaming machine is provided with a refrigeration apparatus having a compressor, it cannot be easily carried and stored in the limited space, and the conduit of the beer encounters the icing problem.

The conventional beer foaming machine is purely used to produce foam and does not have the refrigerating function and a spiral conduit through which the beer flows, so that the poor taste of the beer and the great inconvenience are caused.

BRIEF SUMMARY OF THE INVENTION

In view of this, an objective of the invention is to provide a beverage supplier with emptying and cooling functions to achieve the effects of rapidly cooling the beverage and emptying the beverage to satisfy the requirements of the consumers.

To achieve the above-identified object, the invention provides a beverage supplier, including: an inlet conduit communicated with a beverage container; a pumping and cooling device communicated with the inlet conduit, pumping and cooling a beverage from the beverage container, and outputting a cooled beverage; and an output unit, which is electrically connected to the pumping and cooling device and controls an output of the cooled beverage. In a first state, the pumping and cooling device pumps and cools the beverage from the beverage container through the inlet conduit. In a second state, the pumping and cooling device empties the cooled beverage remained in the pumping and cooling device.

The pumping and cooling device may include: a pump device, which is selectively communicated with the inlet conduit and an external environment; a cooling device, having a cooling inlet and a cooling outlet, wherein the cooling inlet is communicated with a discharge hole of the pump device, and the pump device pumps the beverage from the beverage container to the cooling device for cooling and outputs the cooling outlet from the cooled beverage to control the output of the cooled beverage. In the first state, the pump device pumps the beverage to the cooling device from the beverage container through the inlet conduit. In the second state, the pump device empties the beverage remained in the cooling device.

The pump device may be selectively communicated with the inlet conduit and the external environment, wherein: in the first state, the pump device is communicated with the inlet conduit and discommunicated from the external environment, pumps the beverage from the beverage container to the cooling device; and in the second state, the pump device is communicated with the external environment and discommunicated from the inlet conduit, pumps a gas from the external environment to push the beverage, remained in the cooling device, out of the discharge hole. Alternatively, in the first state, the pump device works in a forward direction, and pumps the beverage from the beverage container to the cooling device through the inlet conduit; and in the second state, the pump device works in a reverse direction, and pumps the beverage, remained in the cooling device, back to the beverage container through the inlet conduit.

The pumping and cooling device may include a three-way valve, a cooling device and a pump. The three-way valve includes: a first inlet communicated with the inlet conduit; a second inlet communicated with the external environment; and an outlet selectively communicated with the first inlet and the second inlet. The cooling device has a cooling inlet and a cooling outlet, and the cooling inlet is communicated with the outlet of the three-way valve. The pump includes: a suction hole communicated with the cooling outlet; and a discharge hole. In the first state, the first inlet of the three-way valve is communicated with the outlet of the three-way valve, and the second inlet of the three-way valve is discommunicated from the outlet of the three-way valve, so that the pump pumps the beverage from the beverage container to the cooling device for cooling, outputs the cooled beverage from the cooling outlet, and pumps the cooled beverage out. In the second state, the second inlet of the three-way valve is communicated with the outlet of the three-way valve, and the first inlet of the three-way valve is discommunicated from the outlet of the three-way valve, so that the pump empties the cooled beverage remained in the cooling device.

With the above-mentioned aspects of the invention, a spiral conduit of the cooling device may be used to rapidly cool the beverage and the cooling device does not occupy too much space in the supplier. By lowering the temperature of the beverage and making bubbles, the beverage with improved taste is produced. Furthermore, the beverage is introduced into and discharged from the cooling device by the action of the three-way valve and the pump. More particularly, the external gas is used to pressurize and empty the liquid beverage remained in the spiral conduit to prevent the liquid beverage of the spiral conduit from remaining and freezing, and prevent the beverage from remaining to affect the taste.

Further scope of the applicability of this disclosure will become apparent from the detailed description given hereinafter. However, it should be understood that the detailed description and specific examples, while indicating preferred embodiments of this disclosure, are given by way of illustration only, since various changes and modifications within the spirit and scope of this disclosure will become apparent to those skilled in the art from this detailed description.

DETAILED DESCRIPTION OF THE INVENTION

Figure 1:
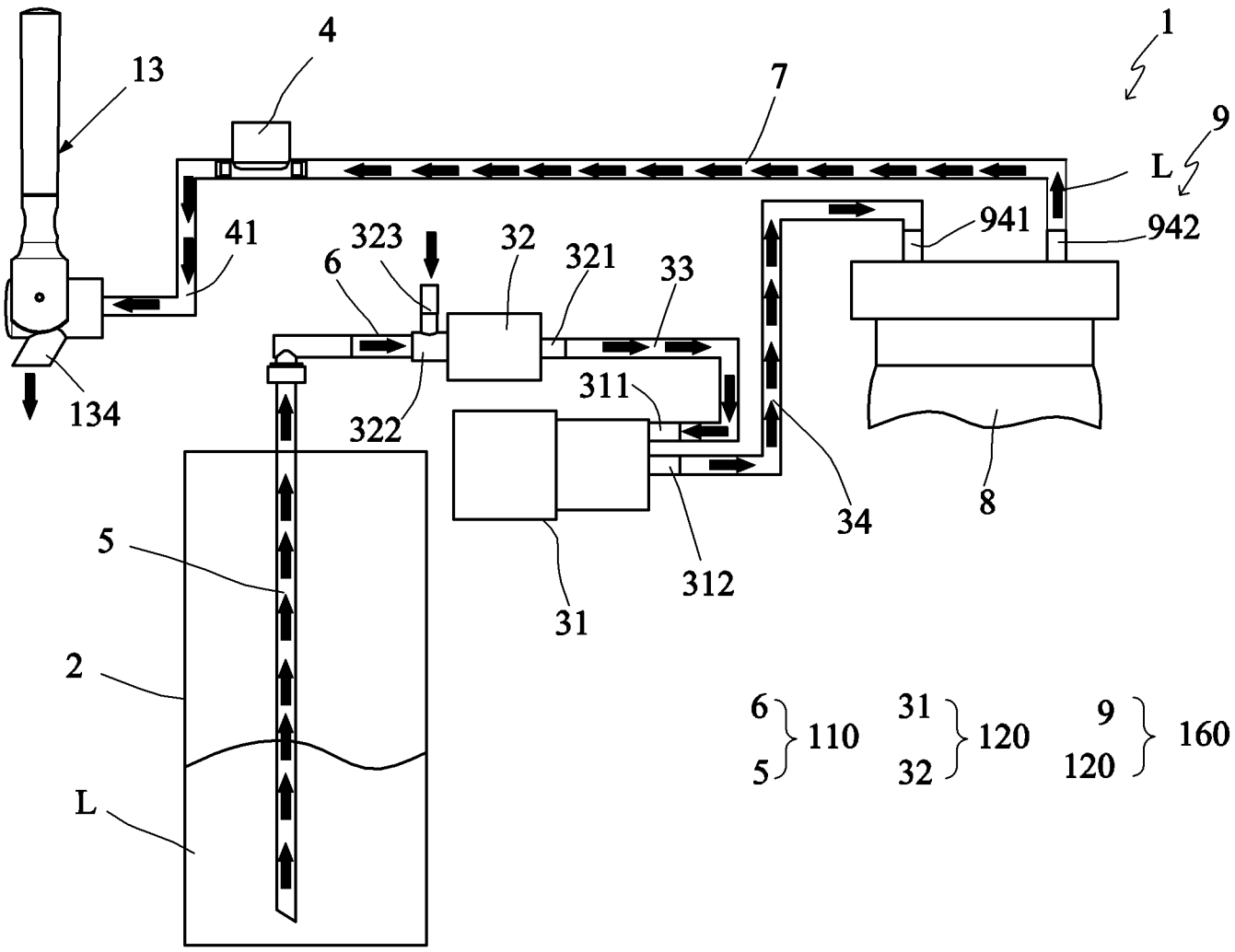
FIG. 1 is a schematic structure view showing a beverage supplier according to a first embodiment of the invention.
Figure 2:
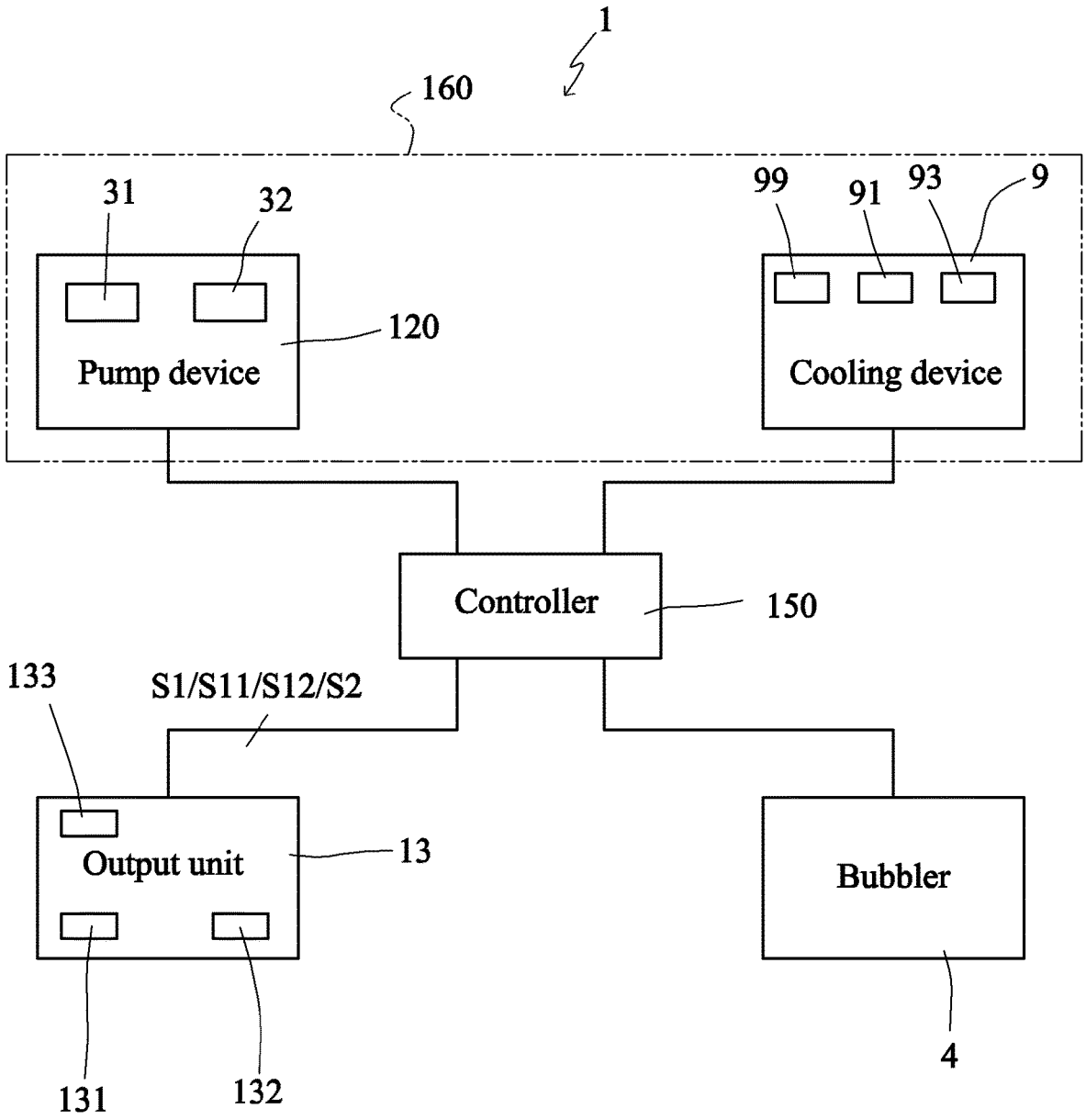
FIG. 2 is a schematic circuit diagram showing the beverage supplier of the first embodiment.

FIGS. 1 and 2 are a schematic structure view and a schematic circuit diagram respectively showing a beverage supplier according to a first embodiment of the invention. As shown in FIGS. 1 and 2, this embodiment provides a beverage supplier 1, which includes an inlet conduit 110, a pumping and cooling device 160 and an output unit 13. The pumping and cooling device 160 is communicated with the inlet conduit 110, pumps and cools a beverage L from a beverage container 2, such as a beverage can, and outputs the cooled beverage L. The output unit 13 is communicated with the pumping and cooling device 160, and is electrically connected to the pumping and cooling device 160 to control the output of the cooled beverage L. In a first state (or beverage introducing state), the pumping and cooling device 160 pumps and cools the beverage L from the beverage container 2 through the inlet conduit 110. In a second state (or beverage emptying state), the pumping and cooling device 160 empties the beverage L remained in the pumping and cooling device 160. In this embodiment, the pumping and cooling device 160 includes a pump device 120 and a cooling device 9. In this non-restrictive embodiment, the output unit 13 includes an electrical portion and a structural portion, the electrical portion includes a first switch 131 and a second switch 132 (of course, a single switch can also be used without necessarily requiring two switches), and the structural portion includes a beverage outlet 134. The beverage outlet 134 is communicated with the pumping and cooling device 160, and a user can place a cup under the beverage outlet 134 to accommodate the beverage. The first switch 131 and the second switch 132 can be enabled by a user pressing or turning a handle. Alternatively, two independent contact switches providing the functions similar to keys may be adopted in the electrical portion of the output unit 13 to judge the first state and the second state. The output unit 13 may also be implemented through other ways. For example, a remote controller or a sensor may be used as the output unit, a beverage control valve having an electronic switch may be used as the output unit, or the beverage control valve may be used in conjunction with a pressure sensor for sensing the pressure in a conduit (such as a second conduit 7 or a fifth conduit 41) to provide the function of the switch to control whether to enable a pump 31 or not. Therefore, any device, unit or module that allows the user to control the output of the beverage can be used as the output unit, and can be considered as falling within the scope of the output unit 13.

The inlet conduit 110 is communicated with the beverage container 2. In this non-limiting example, the inlet conduit 110 includes a suction pipe 5 and a first conduit 6 communicating with each other. The pump device 120 is selectively communicated with the inlet conduit 110 and an external environment. The cooling device 9 has a cooling inlet 941, a cooling chamber 8 and a cooling outlet 942. The cooling inlet 941 is communicated with a discharge hole 312 of the pump device 120, and the pump device 120 pumps the beverage L from the beverage container 2 to the cooling chamber 8 of the cooling device 9 for cooling, and outputs the cooled beverage L from the cooling outlet 942. The output unit 13 is communicated with the cooling outlet 942 through the second conduit 7, and outputs the cooled beverage L.

In the first state, the pump device 120 pumps the beverage L from the beverage container 2 to the cooling device 9 through the inlet conduit 110. More particularly, the pump device 120 is communicated with the inlet conduit 110 and discommunicated from the external environment (i.e., the input and output conduits of the pump device 120 are discommunicated from the external environment) to pump the beverage L from the beverage container 2 to the cooling device 9. In the second state, the pump device 120 empties the beverage L remained in the cooling device 9. More particularly, the pump device 120 is communicated with the external environment and discommunicated from the inlet conduit 110 to pump a gas from the external environment to push the beverage L, remained in the cooling device 9, to the output unit 13 through the discharge hole 312.

In this embodiment, the pump device 120 includes a three-way valve 32 and the pump 31. The three-way valve 32 includes a first inlet 322, a second inlet 323 and an outlet 321. The first inlet 322 is communicated with the inlet conduit 110, the second inlet 323 is communicated with the external environment, and the outlet 321 is selectively communicated with the first inlet 322 and the second inlet 323. The three-way valve 32 may be a three-way solenoid valve and an electric three-way control valve that are easily available on the market, and detailed descriptions thereof will be omitted. It should be noted that multi-way valves such as four-way valves and five-way valves also fall within the scope of the three-way valve. The three-way valve 32 may be manually or automatically operated. The action of switching the three-way valve 32 from the first state to the second state can be enabled by the switch of the output unit 13. After the switch of the output unit 13 is turned off, a controller 150 controls the three-way valve 32 to switch to the second state according to this turn-off time instant. After the pump 31 is stopped or when the switch of the output unit 13 is turned on again, the controller 150 again controls the three-way valve 32 to switch to the first state.

The pump 31 includes a suction hole 311 and the discharge hole 312. The suction hole 311 is communicated with the outlet 321 of the three-way valve 32 through a third conduit 33. The discharge hole 312 is communicated with the cooling inlet 941 through a fourth conduit 34. In the first state, the first inlet 322 of the three-way valve 32 is communicated with the outlet 321 of the three-way valve 32, so that the pump 31 pumps the beverage L from the beverage container 2 to the cooling device 9, and the second inlet 323 of the three-way valve 32 is discommunicated from the outlet 321 of the three-way valve 32. In the second state, the second inlet 323 of the three-way valve 32 is communicated with the outlet 321 of the three-way valve 32, and the first inlet 322 of the three-way valve 32 is discommunicated from the outlet 321 of the three-way valve 32. Consequently, the pump 31 may pump the gas to push out and empty the residual beverage L.

In order to achieve the automatic operation, the beverage supplier 1 may further include the controller 150, which is electrically connected to the pump device 120, the output unit 13 and the cooling device 9. The controller 150 enables the pump device 120 to pump the beverage L to the cooling device 9 for cooling according to an enable signal S1 for enabling the output unit 13.

In order to achieve the action of automatically shutting down or disabling the pump device 120, the controller 150 may delay a predetermined time (for example, but not limited to 5 to 30 seconds) according to the operation time point (the time point when the three-way valve 32 enters the second state because the switch of the output unit 13 is turned off) of the three-way valve 32 of the pump device 120 and then disable the pump 31 of the pump device 120. Alternatively, the controller 150 may disable the pump 31 of the pump device 120 according to a detection signal S2 of a beverage detector 133 when the output unit 13 detects the absence of the beverage in the second state.

In addition, the beverage supplier 1 may further include a bubbler 4 electrically connected to the controller 150, wherein the cooling device 9 is communicated with the bubbler 4 and then communicated with the output unit 13, and the bubbler 4 bubbles the cooled beverage L.

In order to meet the special requirements of the users, the output unit 13 has the first switch (or first-stage switch) 131 and the second switch (or second-stage switch) 132, and both of them may be enabled by the user pressing, twisting or otherwise touching the output unit 13. When the first switch 131 is turned on, the output unit 13 outputs a first request signal S11 of the enable signal S1. At this time, the controller 150 enables the pump device 120 to pump the beverage L to the cooling device 9 for cooling according to the first request signal S11, and further outputs the cooled beverage L from the output unit 13. When the second switch 132 is turned on, the output unit 13 outputs a second request signal S12 of the enable signal S1. At this time, the controller 150 enables the pump device 120 to pump the beverage L to the cooling device 9 for cooling according to the second request signal S12, and further enables the bubbler 4 to bubble the cooled beverage L, which is then outputted from the output unit 13. Of course, The above-mentioned first switch and second switch are only examples of this embodiment, and the invention is not restricted thereto. That is, the beverage supplier 1 may be controlled by a single switch to bubbling the beverage, or may achieve a bubbling or non-bubbling effect by a short or long press of the single switch, and two integrated or separated switches may also used to allow the user to choose whether or not to foam.

Figure 3:
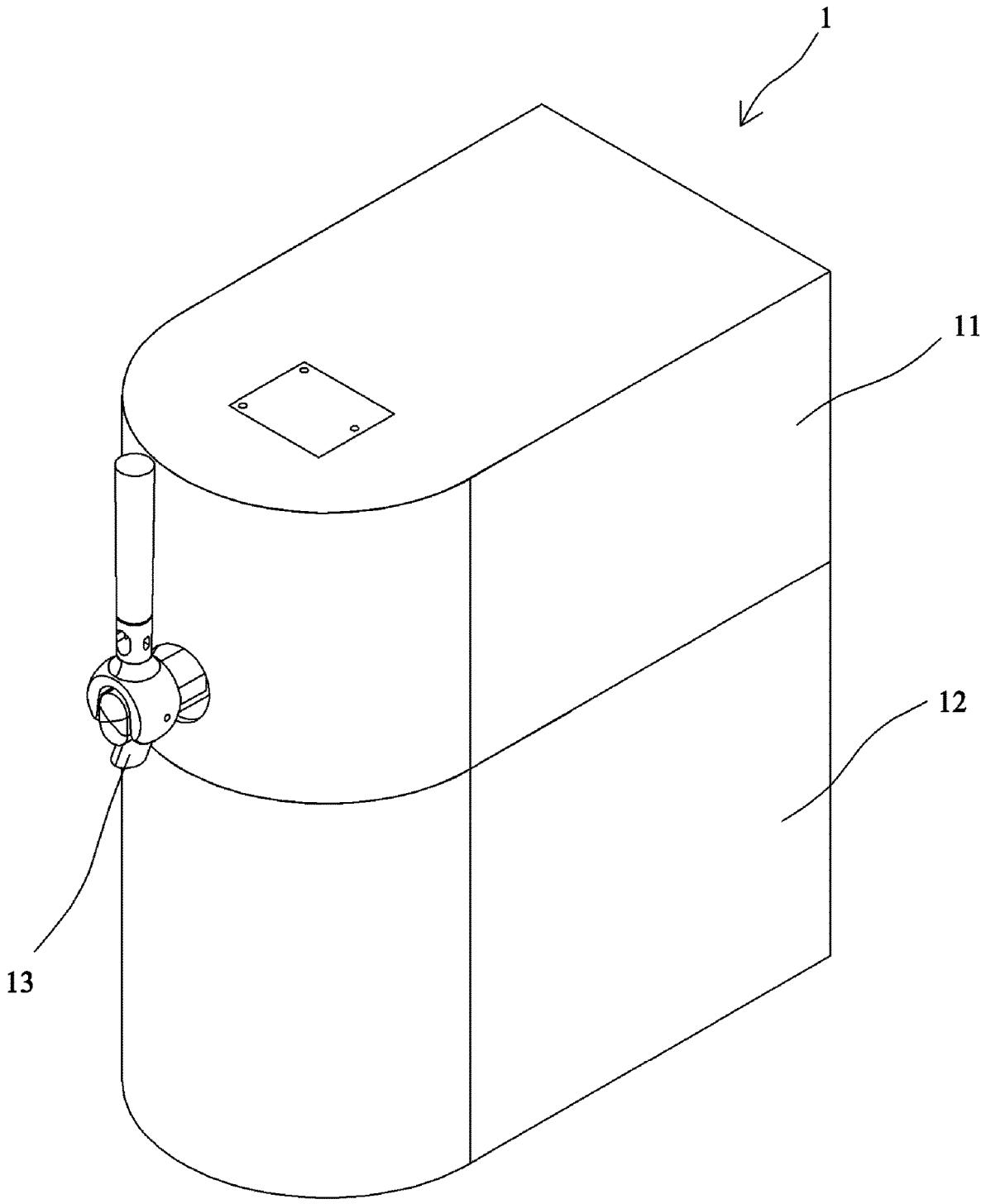
FIG. 3 is a schematically pictorial view showing the beverage supplier of the first embodiment.
Figure 4:
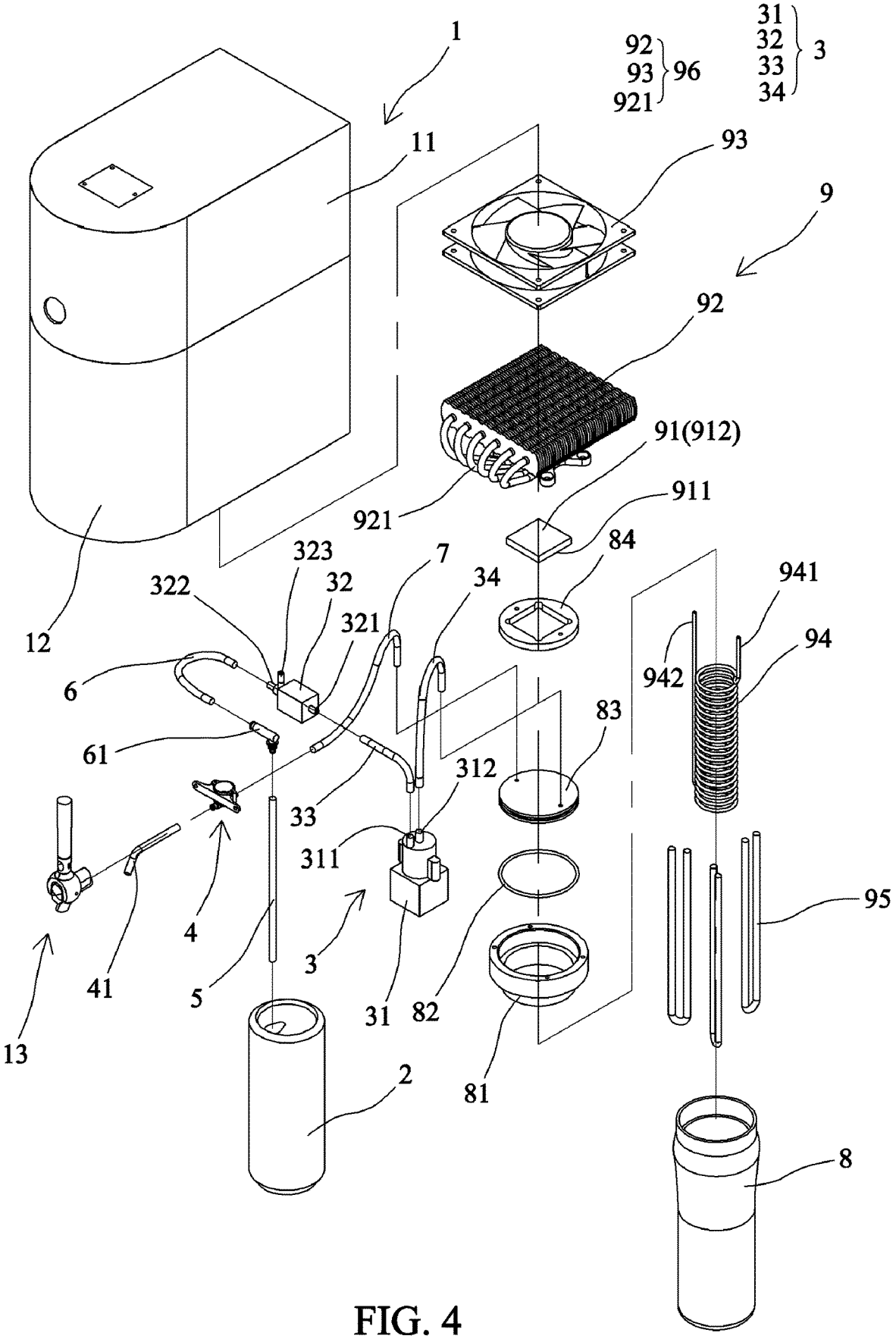
FIG. 4 is a schematically exploded view showing the beverage supplier of the first embodiment.
Figure 5:
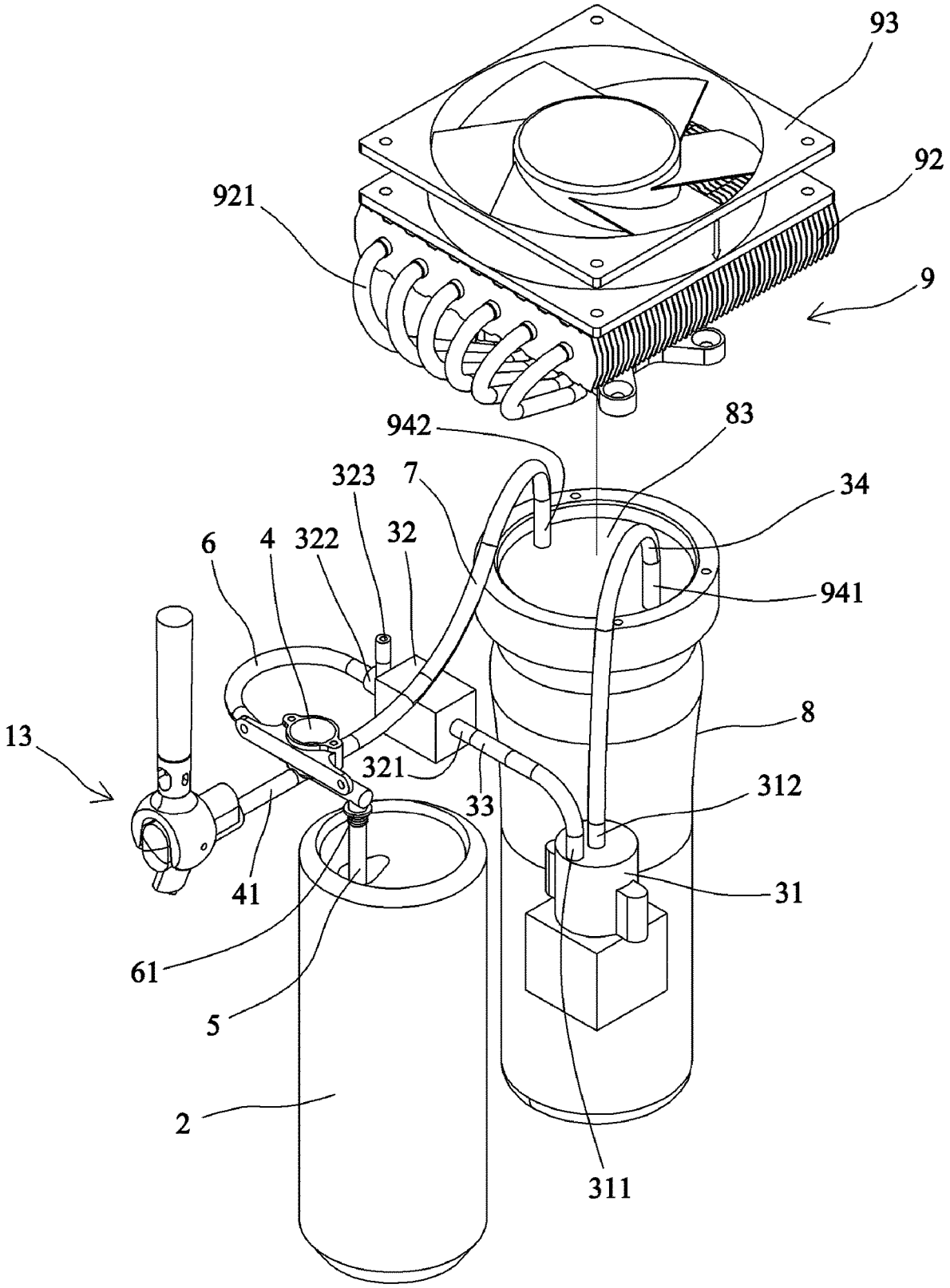
FIG. 5 is a pictorial view showing some internal elements of the beverage supplier of the first embodiment.
Figure 6:
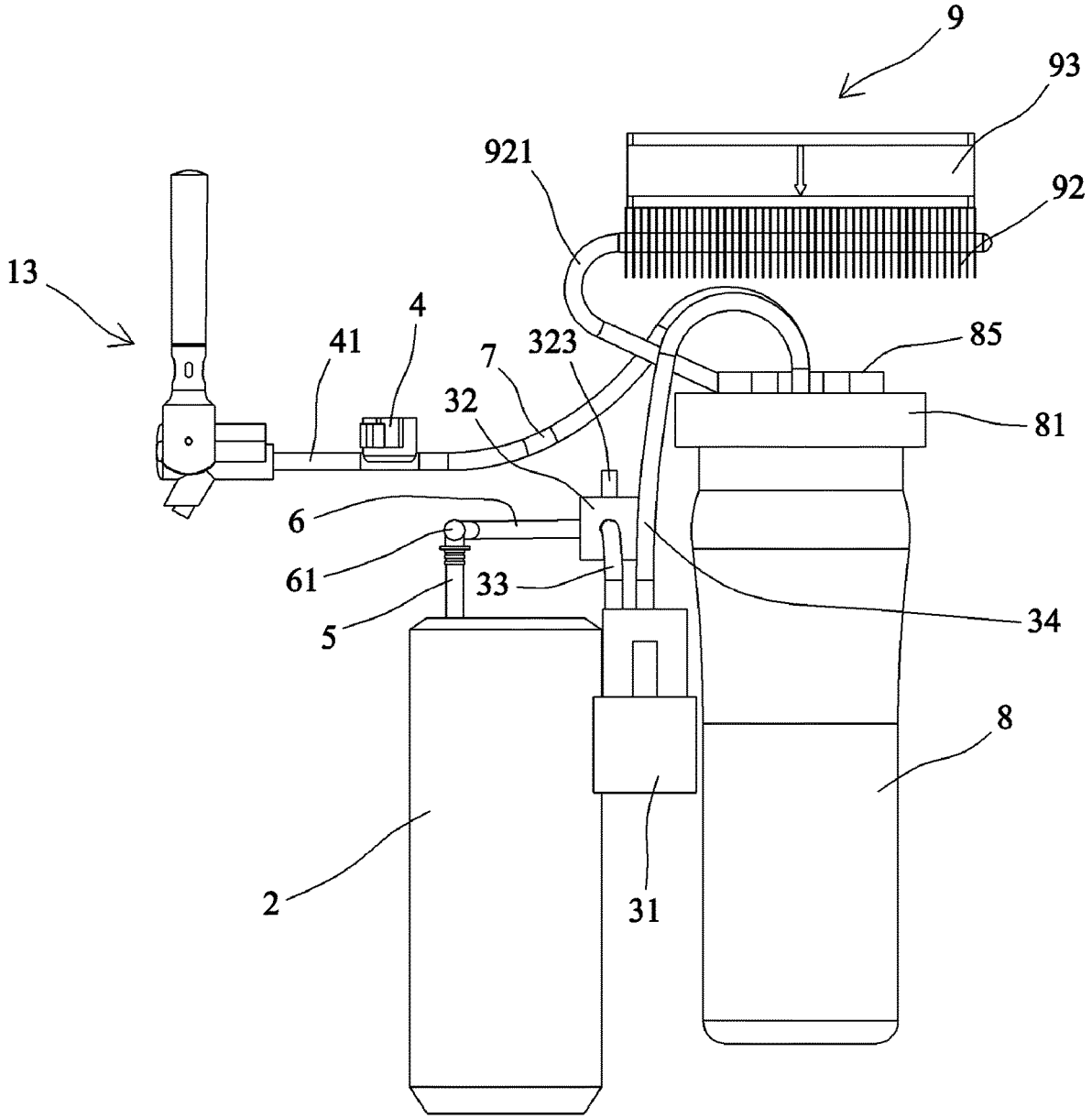
FIG. 6 is a side view showing some internal elements of the beverage supplier of the first embodiment.
Figure 7:
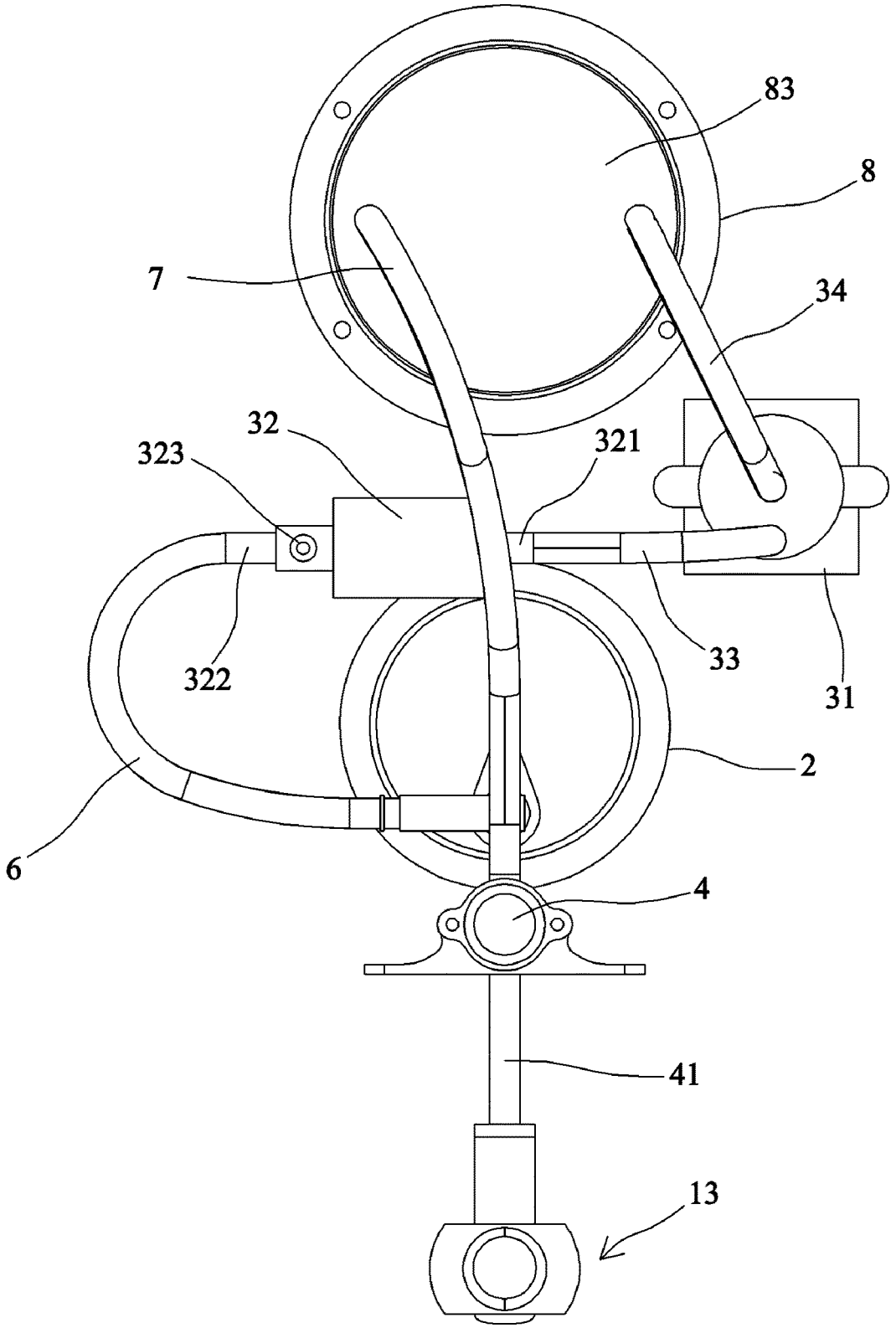
FIG. 7 is a top view showing some internal elements of the beverage supplier of the first embodiment.
Figure 8:
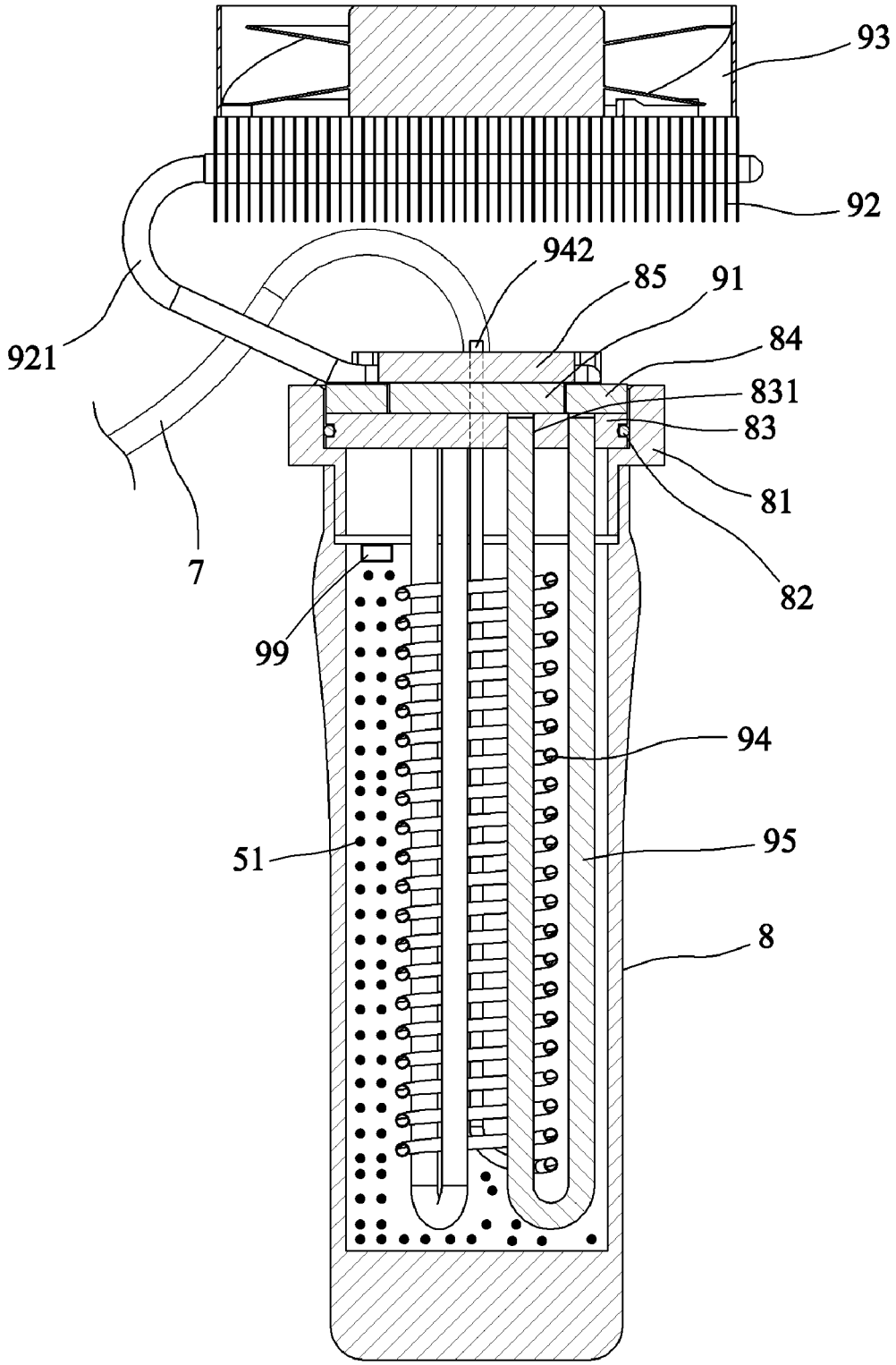
FIG. 8 is a cross-sectional view showing some internal elements of the beverage supplier of the first embodiment.

FIGS. 3 and 4 are a schematically pictorial view and a schematically exploded view showing the beverage supplier of the first embodiment, respectively. FIGS. 5 to 8 are a pictorial view, a side view, a top view and a cross-sectional view showing some internal elements of the beverage supplier of the first embodiment, respectively. As shown in FIGS. 1 and 3, the beverage supplier 1 includes an upper housing 11 and a lower housing 12, the beverage supplier 1 can be preset to have various models, the upper housing 11 and the lower housing 12 are pivotally together, the upper housing 11 can be opened, and the beverage container 2 can be placed in the beverage supplier 1 (the shape of the beverage supplier 1 is not restricted thereto, and the beverage supplier 1 needs not to be constituted by the upper housing 11 and the lower housing 12). The output unit 13 is located between inner and outer sides of the beverage supplier 1. The beverage outlet 134 of the output unit 13 is connected to the bubbler 4 through the fifth conduit 41.

As shown in FIGS. 1 to 8, the beverage supplier 1 is provided with a guiding mechanism 3, the bubbler 4, the suction pipe 5, the first conduit 6, the second conduit 7, the cooling chamber 8 and the cooling device 9. The guiding mechanism 3 includes the pump 31, the three-way valve 32, the third conduit 33 and the fourth conduit 34. There is a plug 61 disposed between the first conduit 6 and the suction pipe 5, and the plug 61 may abut upon an opening of the beverage container 2. The suction pipe 5 is inserted into the upright beverage container 2 and sucks the liquid beverage from the beverage container 2, and the liquid beverage flows to the cooling inlet 941 through the suction pipe 5, the first conduit 6, the three-way valve 32, the third conduit 33, the pump 31 and the fourth conduit 34, so that the beverage is introduced into the cooling device 9 (the beverage may also be reversely placed at a high place, the beverage naturally flows down to the cooling device 9 by gravity, and the first inlet 322 may be opened or closed to achieve the effect of this embodiment).

The cooling device 9 includes the cooling chamber 8, a cooling chip 91, one or multiple cold conduits 95, a spiral conduit 94 and a heat-dissipating device 96. The cooling chamber 8 is made of a heat insulating material and isolates the heat source from the outside. A coolant 51 is accommodated within the cooling chamber 8 to keep the cooling source from being dissipated. The cooling chip 91 is disposed on one side (e.g., the upper side) of the cooling chamber 8, and has a cooling surface 911 and a heat dissipating surface 912. A cold conduit 95 is coupled to the cooling surface 911, and extends into the cooling chamber 8 to provide a cooling source, provided by the cooling surface 911, to the coolant 51 in the cooling chamber 8. The spiral conduit 94 extends into the cooling chamber 8 and has the cooling inlet 941 and the cooling outlet 942, and the beverage L is cooled by the cooling source in the spiral conduit 94 through the coolant 51. The heat-dissipating device 96 is coupled to the heat dissipating surface 912 to dissipate the heat generated by the heat dissipating surface 912.

As shown in FIGS. 4 to 8, the heat-dissipating device 96 includes a heat sink 92, a fan 93 and one or multiple heat pipes 921. Several sets of the cold conduits 95 are disposed below the cooling surface 911 and extend into the cooling chamber 8. The cooling chamber 8 is made of a heat insulating material, the coolant is accommodated within the cooling chamber 8, so that the cold conduit 95 cools the coolant 51, and the coolant 51 cools the spiral conduit 94. Several sets of heat pipes 921 are disposed on the heat dissipating surface 912 and embedded into the heat sink 92, the heat sink 92 has multiple sets of fins, the fan 93 is disposed above the heat sink 92, and the fan 93 generates the air stream flowing to the heat sink 92 to disperse the heat source. An annular cover 81, an O-ring 82, a circular plate 83, a chip positioning frame 84 and a top cover 85 (see FIG. 8) are disposed above the cooling chamber 8. Several through holes 831 (see FIG. 8), through which the cold conduit 95 passes, are formed on the circular plate 83. The chip positioning frame 84 is for positioning the cooling chip 91, and the spiral conduit 94 is disposed in the cooling chamber 8. The spiral conduit 94 is a spiral surrounding body, and the coolant 51 of the cooling chamber 8 cools the beverage in the spiral conduit 94 quickly. After being cooled by the cooling device 9, the beverage enters the bubbler 4 through the second conduit 7 and is bubbled by the bubbler 4 to foam, and then flows out through the fifth conduit 41 and the output unit 13.

As shown in FIGS. 1 to 4, the output unit 13 is a two-stage switch, which is operated by two-stage pressing actions (or by pulling and pressing actions). The first-stage switch is to enable the guiding mechanism 3 (including the inlet conduit 110 and the pump device 120) or even to enable the cooling device 9 to pre-cool in response to the increase in the temperature caused by entry of the beverage with the room temperature), the beverage enters the cooling device 9 for cooling, and the cooled beverage is discharged via the second conduit 7 and the output unit 13. The second-stage switch is to turn on the bubbler 4, the beverage is introduced into the cooling device 9 for cooling, and the cooled and foamed beverage, generated by the operations of the second conduit 7 and the bubbler 4, is discharged via the output unit 13. The bubbler 4 is an ultrasonic oscillator, which vibrates the second conduit 7 at the high frequency, to refine the beverage molecules in the second conduit 7 to enhance the taste, and the beverage is bubbled or foamed by the bubbler 4. Alternatively, the bubbler 4 may also be considered as a combination of an ultrasonic oscillator and the second conduit 7. In the second state, the power of the pump 31 of the guiding mechanism 3 can pressurize the liquid beverage remained in the spiral conduit 94 to empty the beverage, to prevent the liquid beverage of the spiral conduit 94 from remaining and freezing, and to avoid the oxidation of beverages and the drawback of poor taste. It is worth noting that, after the beverage supplier 1 is powered on, the cooling chip 91 of the cooling device 9 can immediately cool down, and the cooling chamber 8 is maintained within a temperature range according to a temperature signal of a temperature sensor 99. As long as the temperature rises, the cool action is enabled. In another embodiment, two separate switches (e.g., front and rear switches or left and right switches) may also be employed to allow the user to choose between foaming and non-foaming of the beverage.

As shown in FIGS. 1 to 8, the invention provides a beverage supplier with the above structural improvements. The user opens the upper housing 11, and opens the cap of the beverage container 2 (or beer can) and put the suction pipe 5 into the beverage container 2. The beverage container 2 (or beer can) can be put into the beverage supplier 1 without being refrigerated in advance, and then the upper housing 11 is closed upon the lower housing 12. The user firstly presses the output unit 13 (the pump 31 and the electronic board control associated with the output unit pertain to the prior art, and detailed descriptions thereof will be omitted), the cooling device 9 starts to operate first, the cooling surface 911 of the cooling chip 91 produces the cooling source, the heat dissipating surface 912 produces the heat source, and the cooling source of the cooling surface 911 is transferred to the cold conduit 95, so that the cold conduit 95 cools the coolant, and the coolant rapidly cools the spiral conduit 94. When the coolant is cooled down to a predetermined temperature (sensed by the temperature sensor 99 of FIG. 8), the guiding mechanism 3, the pump 31 and the three-way valve 32 are automatically enabled by the controller 150, and the suction pipe 5 put into the beverage container 2 sucks the liquid beverage from the beverage container 2. So, the liquid beverage flows to the cooling inlet 941 of the cooling device 9 through the suction pipe 5, the first conduit 6, the first inlet 322, the three-way valve 32 (in the first state), the outlet 321, the third conduit 33, the suction hole 311, the discharge hole 312 of the pump 31 and the fourth conduit 34, so that the beverage is introduced into the cooling device 9 and then flows through the spiral conduit 94 in a helical manner. This helical flowing process allows rapid cooling of the beverage. After the cooling is completed, the cooled beverage is pressurized by the pump 31 and flows from the spiral conduit 94 to the cooling outlet 942 and the second conduit 7, and flows out through the bubbler 4, the fifth conduit 41 and the output unit 13. It is worth noting that in another embodiment, the output unit 13 needs not to include a structural portion, but only needs an electrical portion. In this case, the output unit 13 is only electrically connected to the pumping and cooling device 160 to control the output of the cooled beverage L. That is, the cooled beverage may be directly outputted from the cooling outlet 942, or may be outputted from the fifth conduit 41 to the user's cup after flowing through the bubbler 4.

Figure 9:
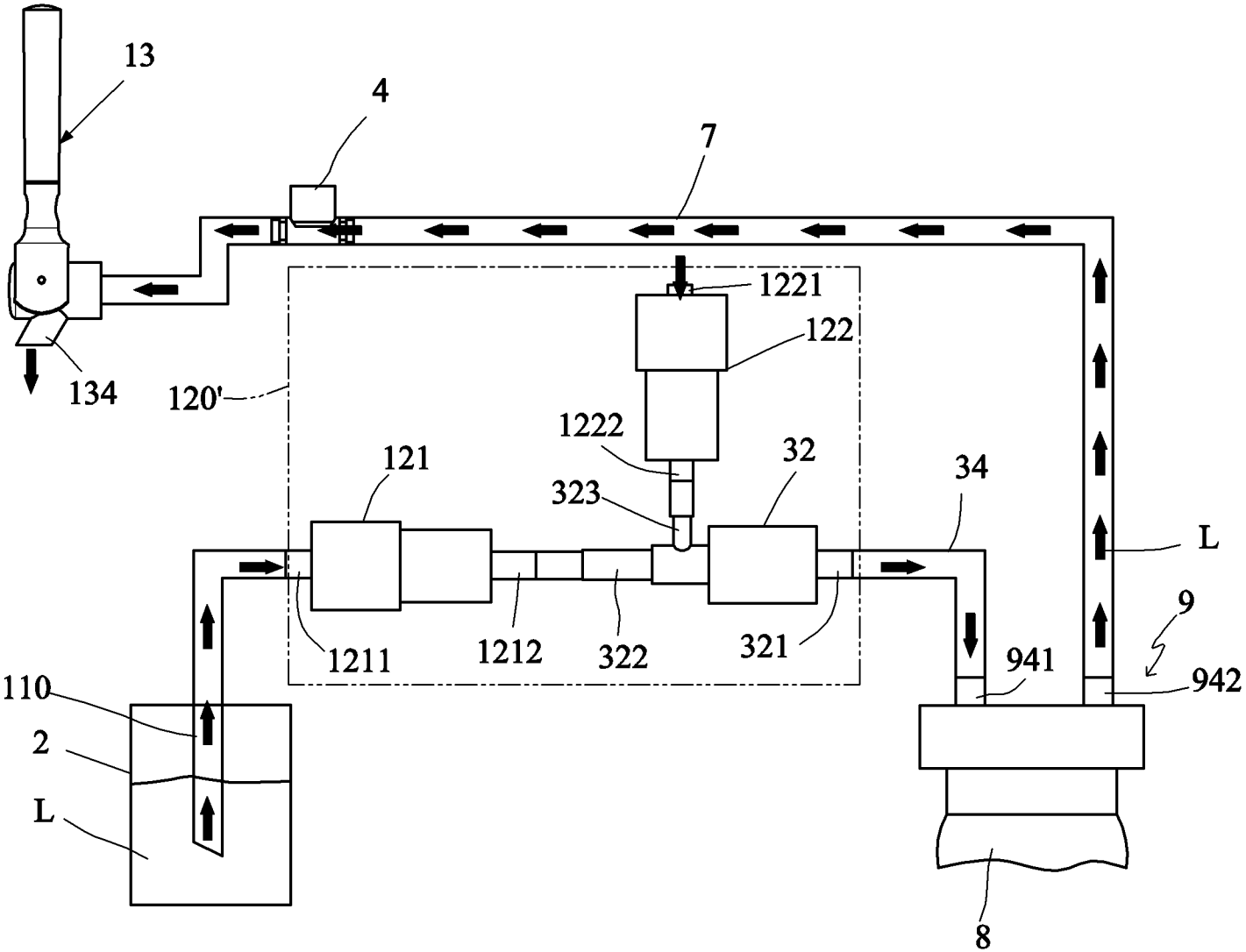
FIG. 9 is a schematic structure view showing a beverage supplier according to a second embodiment of the invention.

FIG. 9 is a schematic structure view showing a beverage supplier according to the second embodiment of the invention. As shown in FIG. 9, a pump device 120' in this embodiment is similar to the first embodiment, and the differences therebetween are explained below. The pump device 120' includes a liquid pump 121, an air pump 122 and a three-way valve 32. The liquid pump 121 includes a suction hole 1211 communicated with the inlet conduit 110; and an outlet 1212. The air pump 122 includes: a suction hole 1221 communicated with the external environment; and an outlet 1222. The first inlet 322 of the three-way valve 32 is communicated with the outlet 1212 of the liquid pump 121. The second inlet 323 is communicated with the outlet 1222 of the air pump 122. The outlet 321 is selectively communicated with the first inlet 322 and the second inlet 323. In the first state, the first inlet 322 of the three-way valve 32 is communicated with the outlet 321 of the three-way valve 32, and the second inlet 323 of the three-way valve 32 is discommunicated from the outlet 321 of the three-way valve 32. At this time, the beverage can be delivered. In the second state, the second inlet 323 of the three-way valve 32 is communicated with the outlet 321 of the three-way valve 32, and the first inlet 322 of the three-way valve 32 is discommunicated from the outlet 321 of the three-way valve 32, so that the air pump 122 pumps the gas of the external environment to push the beverage L, remained in the cooling device 9, out of the cooling device 9.

Figure 10:
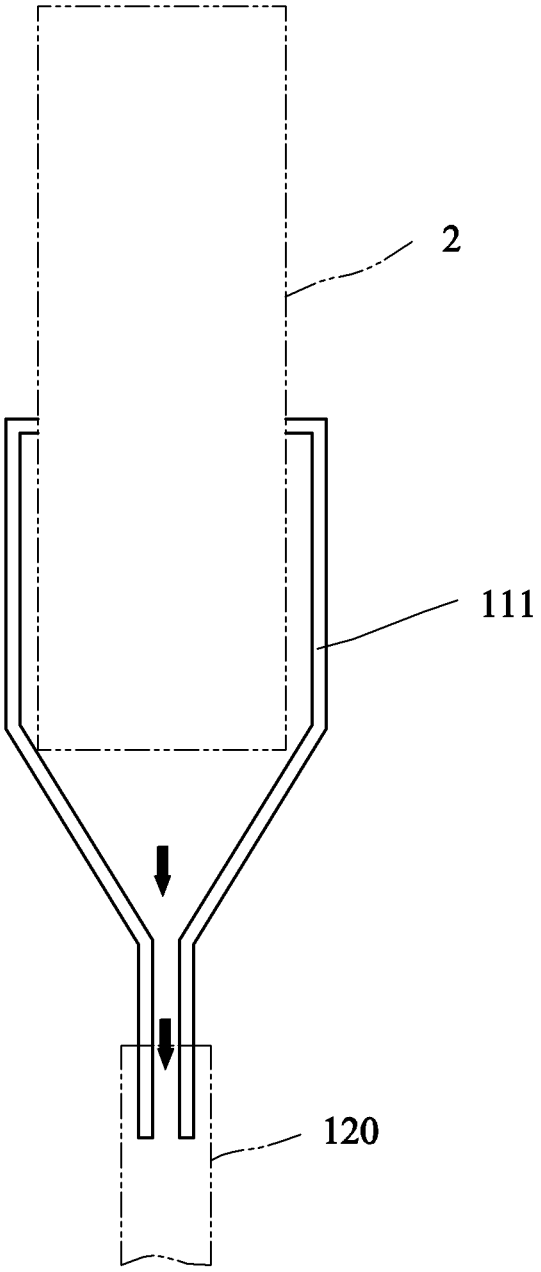
FIG. 10 is a schematically cross-sectional view showing an inlet conduit of a beverage supplier according to a third embodiment of the invention.

FIG. 10 is a schematically cross-sectional view showing an inlet conduit of a beverage supplier according to the third embodiment of the invention. As shown in FIG. 10, the inlet conduit 110 includes a funnel 111 for the placement of inverted beverage container 2. Therefore, the beverage flows into the pump device 120 by way of gravity.

Figure 11:
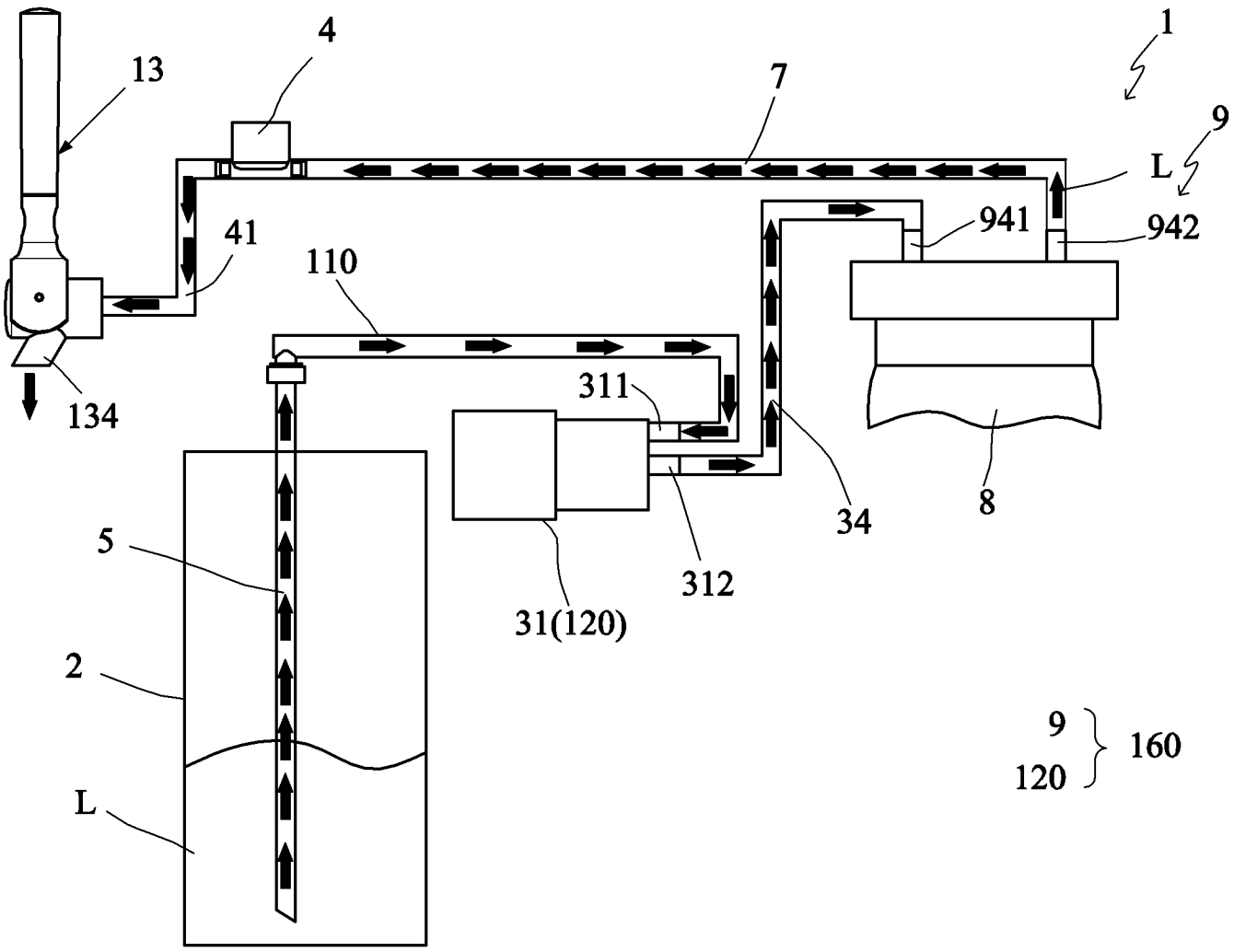
FIG. 11 is a schematic structure view showing a beverage supplier according to a fourth embodiment of the invention.

FIG. 11 is a schematic structure view showing a beverage supplier according to the fourth embodiment of the invention. As shown in FIG. 11, this embodiment is similar to the first embodiment except for the difference that the three-way valve is removed. Therefore, the inlet conduit 110 is directly communicated with the suction hole 311 of the pump 31. Therefore, in the first state, the pump device 120 works in a forward direction (can be controlled by the controller of FIG. 2), and pumps the beverage L from the beverage container 2 to the cooling device 9 through the inlet conduit 110. In the second state, the pump device 120 works in a reverse direction (can be controlled by the controller of FIG. 2), and pumps the beverage L, remained in the cooling device 9, back to the beverage container 2 through the inlet conduit 110. In this way, the effect of emptying the remaining beverage can also be achieved. It is worth noting that the output unit 13 can be additionally provided with a suction valve which only sucks gas and does not discharge the gas or liquid so as to achieve the beverage emptying function when the pump device 120 works in a reverse direction (second state). Alternatively, in the second state, the controller can control the output unit 13 to open or turn on to achieve the function of introducing the gas.

Figure 12:
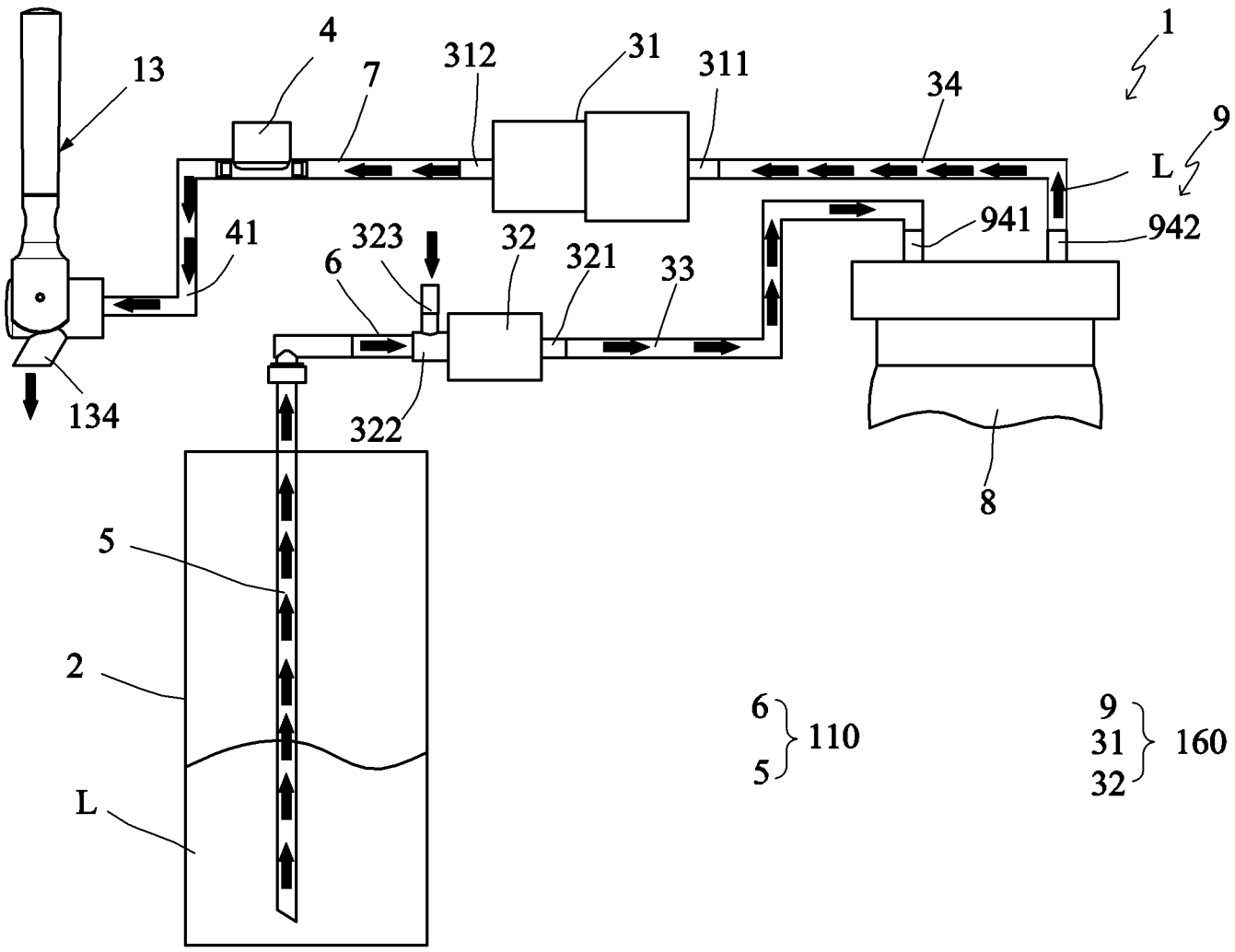
FIG. 12 is a schematic structure view showing a beverage supplier according to a fifth embodiment of the invention.

FIG. 12 is a schematic structure view showing a beverage supplier according to the fifth embodiment of the invention. The pumping and cooling device 160 includes a three-way valve 32, a cooling device 9 and a pump 31. The three-way valve 32 is similar to the first embodiment. The cooling inlet 941 of the cooling device 9 is communicated with the outlet 321 of the three-way valve 32. The suction hole 311 of the pump 31 is communicated with the cooling outlet 942. The discharge hole 312 of the pump 31 is communicated with the output unit 13. In the first state (beverage introducing state), the first inlet 322 of the three-way valve 32 is communicated with the outlet 321 of the three-way valve 32, and the second inlet 323 of the three-way valve 32 is discommunicated from the outlet 321 of the three-way valve 32, so that the pump 31 pumps the beverage L from the beverage container 2 to the cooling device 9 for cooling, outputs the cooled beverage L from the cooling outlet 942, and pumps the cooled beverage L out. In the second state (beverage emptying state), the second inlet 323 of the three-way valve 32 is communicated with the outlet 321 of the three-way valve 32, and the first inlet 322 of the three-way valve 32 is discommunicated from the outlet 321 of the three-way valve 32, so that the pump 31 empties the cooled beverage L remained in the cooling device 9. This can also achieve the above-mentioned function of the invention.

The embodiments of the invention use the cooling chip to achieve the objective of rapidly cooling the beverage. There is no need for a compressor. Because of its small volume, it does not occupy too much space in the supplier. In addition, the spiral conduit of the cooling chamber is designed to gradually cool the beverage upon flowing in a sequential progressive manner. The beverage can be rapidly cooled and bubbled for drinking without placing the refrigerated beverage can into the beverage supplier. Thus, it is possible to eliminate the inconvenience of the traditional beer foaming machine that needs to wait for refrigeration of the beer in advance. The supplier can provide the beverage at any time and this is a function that cannot be achieved by the conventional beer foaming machine.

While this disclosure has been described by way of examples and in terms of preferred embodiments, it is to be understood that this disclosure is not limited thereto. To the contrary, it is intended to cover various modifications. Therefore, the scope of the appended claims should be accorded the broadest interpretation so as to encompass all such modifications.

What is claimed is:

1. A beverage supplier, comprising:

an inlet conduit communicated with a beverage container;

a pumping and cooling device, which is communicated with the inlet conduit, pumps and cools a beverage from the beverage container, and outputs a cooled beverage; and an output unit, which is electrically connected to the pumping and cooling device, and controls an output of the cooled beverage, wherein:

in a first state, the pumping and cooling device pumps and cools the beverage from the beverage container through the inlet conduit; and in a second state, the pumping and cooling device empties the cooled beverage remained in the pumping and cooling device, and the pumping and cooling device pumps a gas from an external environment to push out the cooled beverage remained in the pumping and cooling device.

2. The beverage supplier according to claim 1, wherein the pumping and cooling device comprises:

a pump device communicated with the inlet conduit; and a cooling device having a cooling inlet and a cooling outlet, wherein the cooling inlet is communicated with a discharge hole of the pump device, and the pump device pumps the beverage from the beverage container to the cooling device for cooling and outputs the cooled beverage from the cooling outlet, wherein:

in the first state, the pump device pumps the beverage to the cooling device from the beverage container through the inlet conduit; and in the second state, the pump device empties the cooled beverage remained in the cooling device.

3. The beverage supplier according to claim 2, wherein the pump device is selectively communicated with the inlet conduit and the external environment, wherein:

in the first state, the pump device is communicated with the inlet conduit and discommunicated from the external environment, and pumps the beverage from the beverage container to the cooling device; and in the second state, the pump device is communicated with the external environment and discommunicated from the inlet conduit, pumps the gas from the external environment to push the cooled beverage, remained in the cooling device, out of the discharge hole.

4. The beverage supplier according to claim 3, wherein the pump device comprises:

a three-way valve comprising: a first inlet communicated with the inlet conduit; a second inlet communicated with the external environment; and an outlet selectively communicated with the first inlet and the second inlet; and a pump comprising: a suction hole communicated with the outlet of the three-way valve; and the discharge hole, wherein in the first state, the first inlet of the three-way valve is communicated with the outlet of the three-way valve, and the second inlet of the three-way valve is discommunicated from the outlet of the three-way valve; and in the second state, the second inlet of the three-way valve is communicated with the outlet of the three-way valve, and the first inlet of the three-way valve is discommunicated from the outlet of the three-way valve.

5. The beverage supplier according to claim 3, wherein the pump device comprises:

a liquid pump comprising: a suction hole communicated with the inlet conduit; and an outlet;

an air pump comprising: a suction hole communicated with the external environment; and an outlet; and a three-way valve comprising: a first inlet communicated with the outlet of the liquid pump; a second inlet communicated with the outlet of the air pump; and an outlet selectively communicated with the first inlet and the second inlet, wherein in the first state, the first inlet of the three-way valve is communicated with the outlet of the three-way valve, and the second inlet of the three-way valve is discommunicated from the outlet of the three-way valve; and in the second state, the second inlet of the three-way valve is communicated with the outlet of the three-way valve, and the first inlet of the three-way valve is discommunicated from the outlet of the three-way valve, so that the air pump pumps the gas from the external environment to push out the cooled beverage remained in the cooling device.

6. The beverage supplier according to claim 3, further comprising a controller electrically connected to the pump device, the output unit and the cooling device, wherein the controller enables the pump device to pump the beverage to the cooling device for cooling according to an enable signal for enabling the output unit.

7. The beverage supplier according to claim 6, wherein in the second state:

the controller delays a predetermined time from an operation time point of a three-way valve of the pump device, and then disables a pump of the pump device; or the controller disables the pump of the pump device according to a detection signal of a beverage detector of the output unit detecting absence of the beverage.

8. The beverage supplier according to claim 6, further comprising a bubbler, which is electrically connected to the controller, and bubbles the cooled beverage.

9. A beverage supplier, comprising:

an inlet conduit communicated with a beverage container;

a pumping and cooling device, which is communicated with the inlet conduit, pumps and cools a beverage from the beverage container, and outputs a cooled beverage, and an output unit, which is electrically connected to the pumping and cooling device, and controls an output of the cooled beverage, wherein the pumping and cooling device comprises:

a pump device communicated with the inlet conduit; and a cooling device having a cooling inlet and a cooling outlet, wherein the cooling inlet is communicated with a discharge hole of the pump device, and the pump device pumps the beverage from the beverage container to the cooling device for cooling and output the cooled beverage from the cooling outlet, wherein in a first state, the pumping and cooling device pumps and cools the beverage from the beverage container through the inlet conduit, and the pump device works in a forward direction, and pumps the beverage to the cooling device from the beverage container through the inlet conduit; and in a second state, the pumping and cooling device empties the cooled beverage remained in the pumping and cooling device, the pump device empties the cooled beverage remained in the cooling device, and pump device works in a reverse direction, and pumps the cooled beverage, remained in the cooling device, back to the beverage container through the inlet conduit.

10. The beverage supplier according to claim 1, wherein the pumping and cooling device comprises:

a three-way valve comprising: a first inlet communicated with the inlet conduit; a second inlet communicated with the external environment; and an outlet selectively communicated with the first inlet and the second inlet;

a cooling device having a cooling inlet and a cooling outlet, wherein the cooling inlet is communicated with the outlet of the three-way valve; and a pump comprising: a suction hole communicated with the cooling outlet; and a discharge hole, wherein:

in the first state, the first inlet of the three-way valve is communicated with the outlet of the three-way valve, and the second inlet of the three-way valve is discommunicated from the outlet of the three-way valve, so that the pump pumps the beverage from the beverage container to the cooling device for cooling, outputs the cooled beverage from the cooling outlet, and pumps the cooled beverage out; and in the second state, the second inlet of the three-way valve is communicated with the outlet of the three-way valve, and the first inlet of the three-way valve is discommunicated from the outlet of the three-way valve, so that the pump empties the cooled beverage remained in the cooling device.

11. The beverage supplier according to claim 8, wherein: the output unit has a first switch and a second switch; when the first switch is turned on, the output unit outputs a first request signal of the enable signal; and when the second switch is turned on, the output unit outputs a second request signal of the enable signal, wherein:

the controller enables the pump device to pump the beverage to the cooling device for cooling according to the first request signal, and further outputs the cooled beverage from the output unit; and the controller enables the pump device to pump the beverage to the cooling device for cooling according to the second request signal, and further enables the bubbler to bubble the cooled beverage, which is then outputted from the output unit.

12. The beverage supplier according to claim 2, wherein the cooling device comprises:

a cooling chamber accommodating a coolant;

a cooling chip, which is disposed on one side of the cooling chamber, and has a cooling surface and a heat dissipating surface;

a cold conduit, which is coupled to the cooling surface, extends into the cooling chamber, and provides a cooling source, provided by the cooling surface, to the coolant of the cooling chamber;

a spiral conduit, which extends into the cooling chamber and has the cooling inlet and the cooling outlet, wherein the beverage in the spiral conduit is cooled by the cooling source through the coolant; and a heat-dissipating device, which is coupled to the heat dissipating surface and dissipates heat from the heat dissipating surface.

13. The beverage supplier according to claim 12, wherein after the beverage supplier is turned on, the cooling chip of the cooling device cools the cooling chamber, and keeps a temperature of the cooling chamber within a temperature range according to a temperature signal of a temperature sensor of the beverage supplier.

14. The beverage supplier according to claim 1, wherein in the first state, a pump device of the pumping and cooling device pumps the beverage into a cooling device of the pumping and cooling device, which cools the beverage.

15. The beverage supplier according to claim 1, wherein in the second state, a pump device of the pumping and cooling device empties the cooled beverage remained in a spiral conduit of a cooling device of the pumping and cooling device.

* * * * *